US008056749B2

(12) United States Patent
Robinson

(10) Patent No.: US 8,056,749 B2
(45) Date of Patent: Nov. 15, 2011

(54) FLIP-LID DISPENSING CLOSURE AND PACKAGE

(75) Inventor: Philip J. Robinson, Sylvania, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 1226 days.

(21) Appl. No.: 11/800,539

(22) Filed: May 7, 2007

(65) Prior Publication Data

US 2008/0277369 A1 Nov. 13, 2008

(51) Int. Cl.
*B65D 17/32* (2006.01)
*B65D 43/16* (2006.01)
*B65D 51/18* (2006.01)

(52) U.S. Cl. ..... 220/254.3; 220/268; 220/837

(58) Field of Classification Search ..... 220/254.3, 220/268, 269, 276, 839, 836, 837, 259.1
See application file for complete search history.

(56) References Cited

U.S. PATENT DOCUMENTS

| | | | | |
|---|---|---|---|---|
| 3,629,901 | A | 12/1971 | Wolf | |
| 4,346,810 | A | 8/1982 | Kneissl | |
| 4,403,712 | A | 9/1983 | Wiesinger | |
| 4,809,875 | A * | 3/1989 | Takano | 220/835 |
| 4,883,193 | A * | 11/1989 | Christensson | 220/266 |
| 4,911,324 | A | 3/1990 | Dubach | |
| 4,934,556 | A * | 6/1990 | Kleissendorf | 220/269 |
| 5,078,296 | A | 1/1992 | Amidzich | |
| 5,083,671 | A | 1/1992 | Hayes | |
| 5,115,931 | A | 5/1992 | Dubach | |
| 5,257,708 | A * | 11/1993 | Dubach | 220/827 |
| 5,270,011 | A * | 12/1993 | Altherr | 422/102 |
| 5,322,176 | A | 6/1994 | Dubach | |
| 5,335,802 | A | 8/1994 | Brach et al. | |
| 5,400,912 | A | 3/1995 | Brown et al. | |
| 5,540,343 | A | 7/1996 | Schumacher | |
| 5,779,110 | A | 7/1998 | Brown et al. | |
| 6,253,937 | B1 | 7/2001 | Anderson | |

(Continued)

FOREIGN PATENT DOCUMENTS

DE 75 14049 11/1976

(Continued)

OTHER PUBLICATIONS

PCT Notification, Search Report and Written Opinion Mailed Aug. 26, 2008.

*Primary Examiner* — Mickey Yu
*Assistant Examiner* — Niki Eloshway
(74) *Attorney, Agent, or Firm* — Reising Ethington PC

(57) ABSTRACT

A plastic closure includes a base molded as one piece with a lid and integrally connected to the lid by a hinge. The lid is radially inwardly displaced from an outer periphery of the base. The hinge has a central portion with a convex outer surface, with the lid closed and as viewed in side elevation, that blends with a smooth curvature into outer surfaces of the lid and the base. The hinge has laterally spaced end portions on opposite sides of the central portion and having concave outer surfaces when the lid is closed. The base preferably has a circular periphery and the end portions of the hinge are angularly spaced from each other. The outer surface of the lid preferably is flat, and the lid preferably is integrally connected to the base as molded by at least one frangible bridge spaced from the hinge.

15 Claims, 5 Drawing Sheets

U.S. PATENT DOCUMENTS

| | | | | |
|---|---|---|---|---|
| 6,283,317 | B1 | 9/2001 | Benoit-gonin et al. | |
| 6,347,716 | B1 * | 2/2002 | Nofer et al. | 215/235 |
| 6,419,101 | B1 | 7/2002 | Hessel et al. | |
| 6,431,384 | B1 * | 8/2002 | Dubach | 220/258.5 |
| 7,073,679 | B1 * | 7/2006 | Lagler et al. | 220/259.1 |
| 7,281,638 | B2 * | 10/2007 | Hierzer et al. | 220/257.1 |
| 7,556,162 | B2 * | 7/2009 | Myhre | 215/235 |
| 2002/0104843 | A1 * | 8/2002 | Smith et al. | 220/270 |
| 2003/0062369 | A1 * | 4/2003 | Hierzer et al. | 220/259.1 |
| 2003/0205549 | A1 * | 11/2003 | Harrold et al. | 215/230 |
| 2004/0256347 | A1 | 12/2004 | Druit et al. | |
| 2005/0067366 | A1 | 3/2005 | Dubach | |
| 2007/0045315 | A1 * | 3/2007 | Evans et al. | 220/254.3 |
| 2008/0073311 | A1 * | 3/2008 | Jelich et al. | 215/305 |

FOREIGN PATENT DOCUMENTS

| | | | |
|---|---|---|---|
| DE | 4335107 | A1 | 4/1995 |
| EP | 1487712 | B1 | 10/2006 |

* cited by examiner

FLIP-LID DISPENSING CLOSURE AND PACKAGE

The present disclosure relates to a dispensing closure having a flip-lid that is molded as one piece with the lid in the closed position and to a package that includes such a closure.

BACKGROUND AND SUMMARY OF THE DISCLOSURE

A general object of the present disclosure is to provide a flip-lid dispensing closure molded as one piece with the lid in the closed position, and to provide a package that includes such a closure, in which the hinge that couples the lid to the base of the closure smoothly blends into the adjacent surfaces of the lid and the base and functions as a snap hinge resiliently to hold the lid in the open position and the closed position.

The present disclosure embodies a number of aspects that can be implemented separately from or in combination with each other.

A plastic closure in accordance with one aspect of the present disclosure includes a base molded as one piece with a lid and integrally connected to the lid by a hinge. The lid is radially inwardly displaced from an outer periphery of the base. The hinge has a central portion with a convex outer surface, with the lid closed and as viewed in side elevation, that blends with a smooth curvature into outer surfaces of the lid and the base. The hinge has laterally spaced end portions on opposite sides of the central portion and having concave outer surfaces when the lid is closed. The base preferably has a circular periphery and the end portions of the hinge are angularly spaced from each other. The outer surface of the lid preferably is flat, and the lid preferably is integrally connected to the base as molded by at least one frangible bridge spaced from the hinge.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
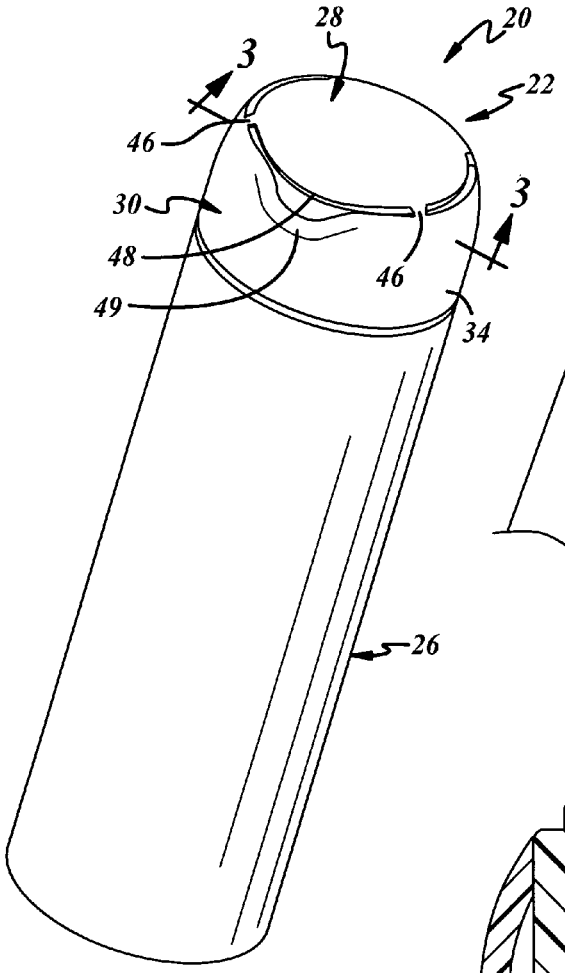
FIG. 1 is a perspective view of a closure and container package in accordance with an exemplary embodiment of the present disclosure.
Figure 2:
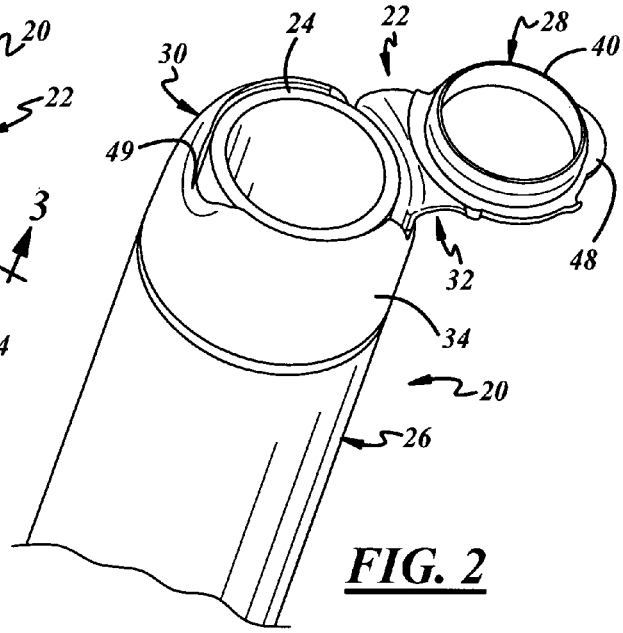
FIG. 2 is a fragmentary perspective view of the package in FIG. 1 with the closure lid open.
Figure 3:
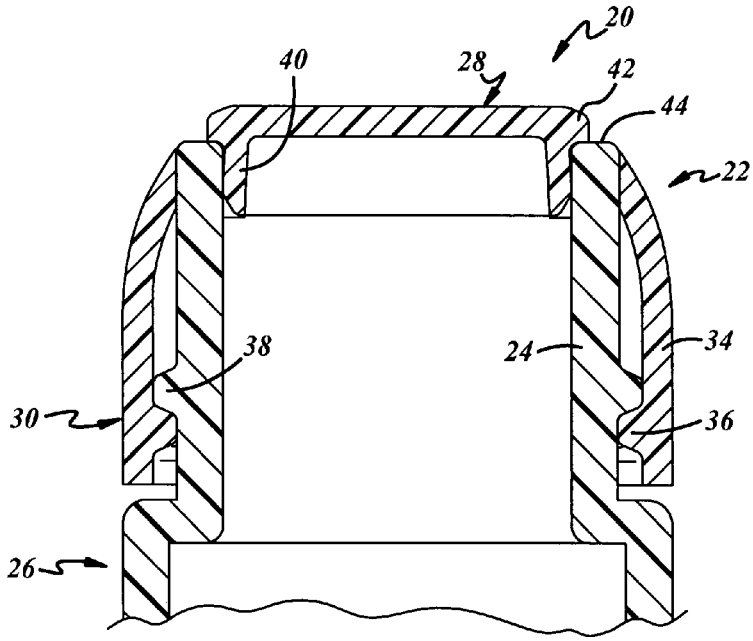
FIG. 3 is a fragmentary sectional view taken substantially along the line 3-3 in FIG. 1.
Figure 4:
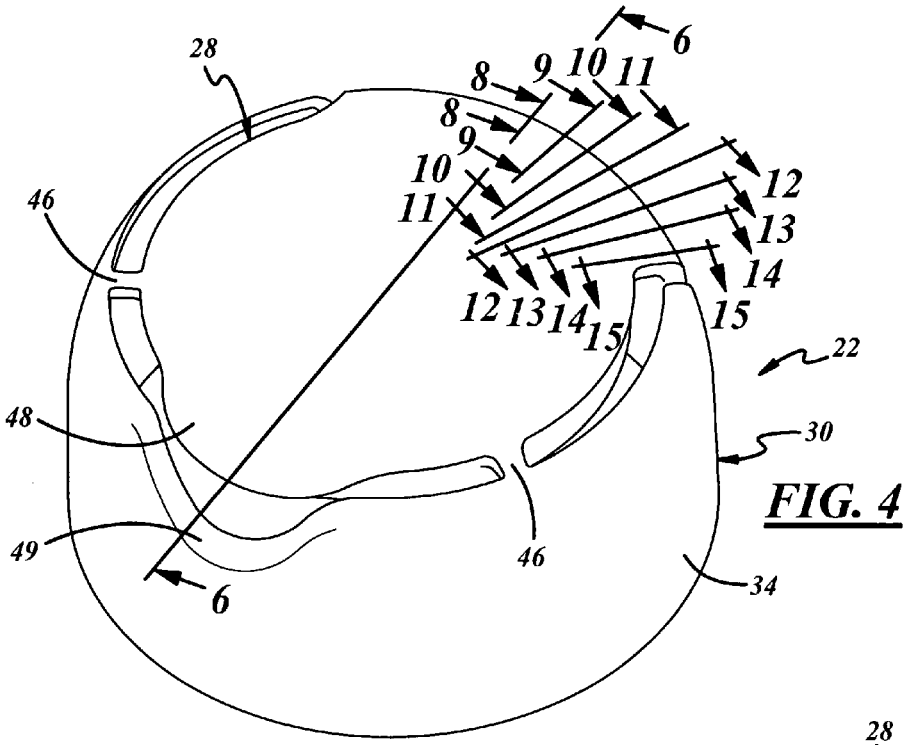
FIG. 4 is a front perspective view of the closure in the package of FIGS. 1-3.

FIGS. 1-3 illustrate a package 20 in accordance with an exemplary embodiment of the present disclosure as including a flip-lid dispensing closure 22 applied to the neck finish 24 of a container 26. Closure 22 includes a flip-lid 28 connected to a base 30 by a hinge 32. Closure 22 is molded as one piece with lid 28 in the closed position illustrated in FIGS. 1 and 3 (and FIGS. 4-6 and 8-10). Base 30 preferably has a circular skirt 34 with an internal attachment feature coupled to container neck finish 24, in this example an internal bead 36 received by snap fit over an external bead 38 on neck finish 24. Bead 36 and/or bead 38 can be circumferentially continuous or discontinuous. Lid 28 preferably is substantially flat and has an annular wall 40 received in plug-sealing engagement within the mouth of container neck finish 24. The periphery 42 of lid 28 extending beyond wall 40 preferably seats against and overlies the end surface 44 of neck finish 24. Closure 22 preferably is molded with lid 28 in the closed position illustrated in FIGS. 1 and 3. Lid 28 preferably is connected to base 30 as molded by at least one frangible bridge 46 spaced from hinge 32. Rupture of bridge(s) 46 provides an indication that the lid has been opened. There preferably is sufficient friction between annular wall 40 and neck finish 24 to hold lid 28 closed after bridge(s) 46 is (are) ruptured. A thumb tab 48 projects from lid 28 opposite hinge 32 to facilitate opening of the lid. A recess 49 preferably is provided in the upper edge of skirt 34 beneath thumb tab 48 to facilitate access to the thumb tab. Closure 22 can be of any suitable plastic construction. Container 26 can be of glass or, more preferably, plastic construction.

Figure 5:
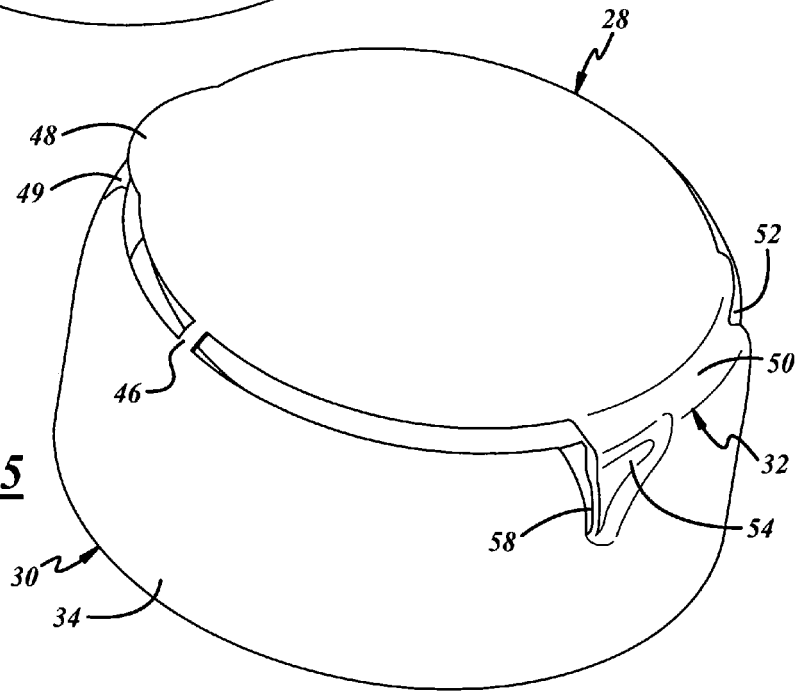
FIG. 5 is a rear perspective view of the closure in FIG. 4 as molded.
Figure 6:
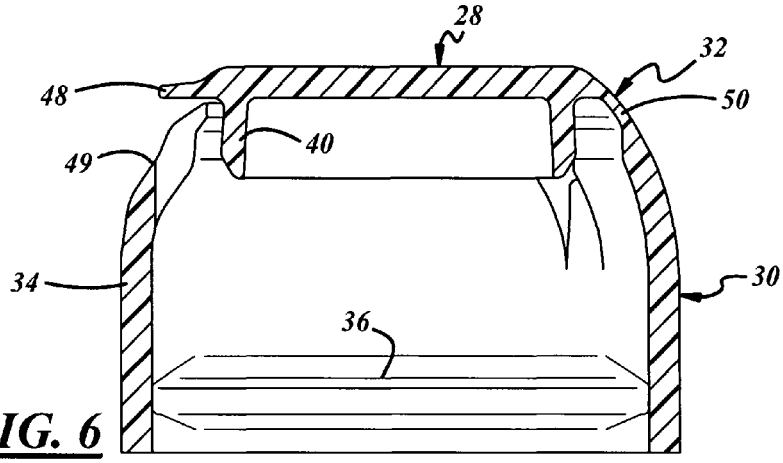
FIG. 6 is a sectional view taken substantially the line 6-6 in FIG. 4.
Figure 7:
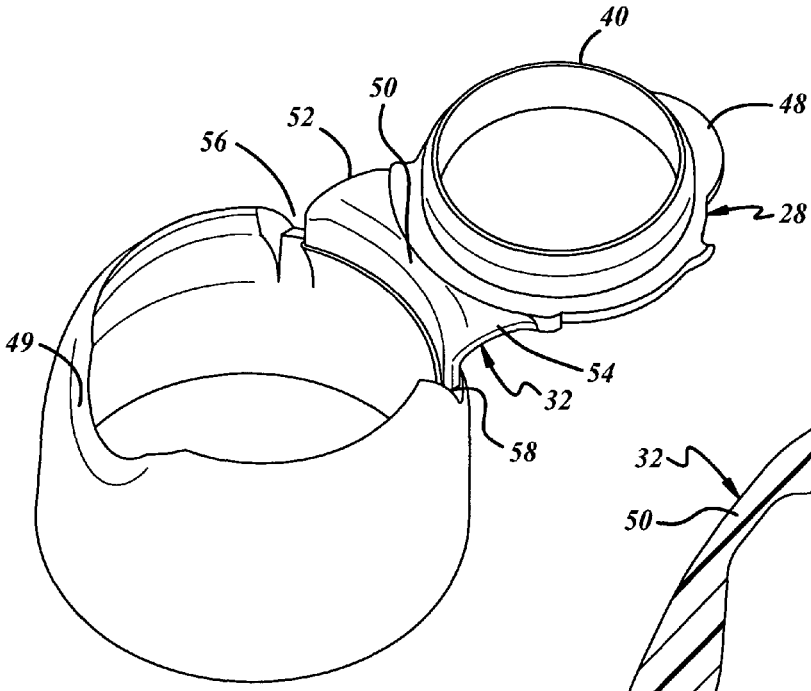
FIG. 7 is a front perspective view of the closure in FIGS. 4-6 with the lid open.
Figure 8:
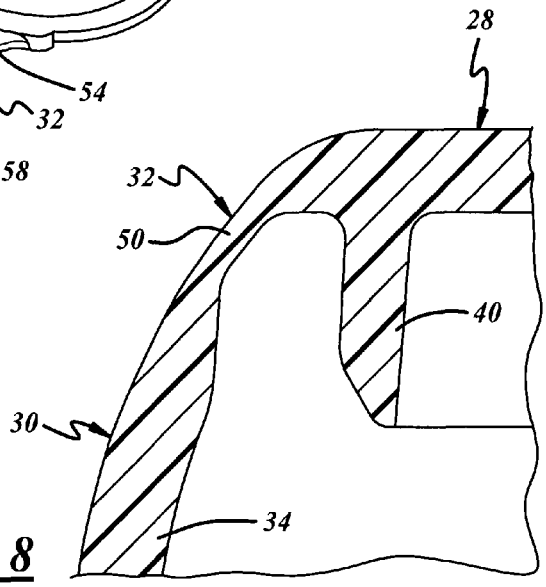
FIGS. 8-15 are fragmentary sectional views taken substantially along the respective lines 8-8, 9-9, 10-10, 11-11, 12-12, 13-13, 14-14 and 15-15 in FIG. 4.
Figure 9:
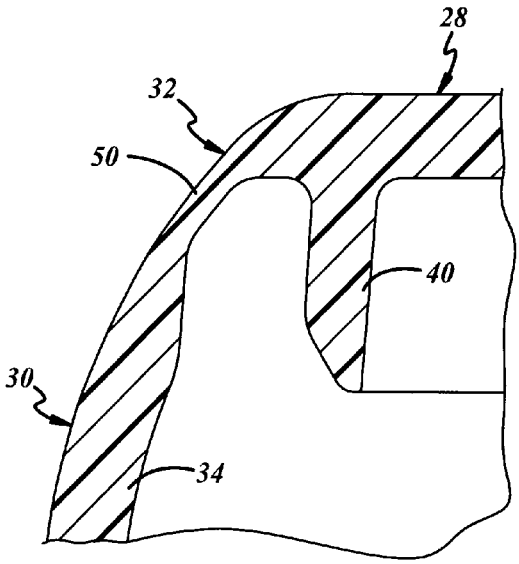
Figure 10:
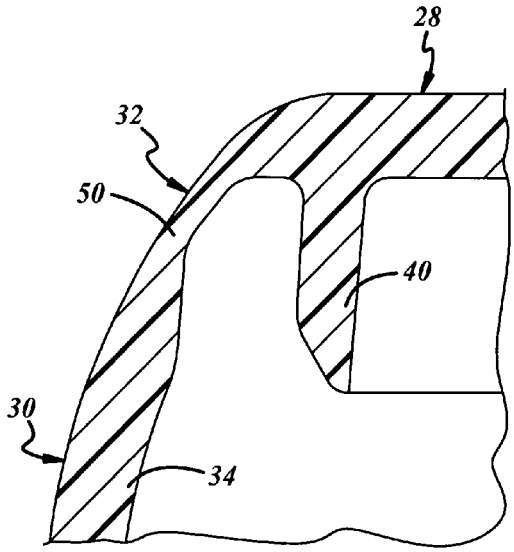
Figure 11:
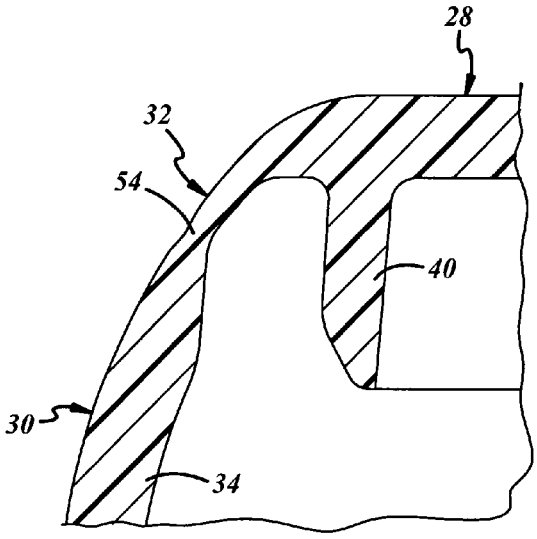
Figure 12:
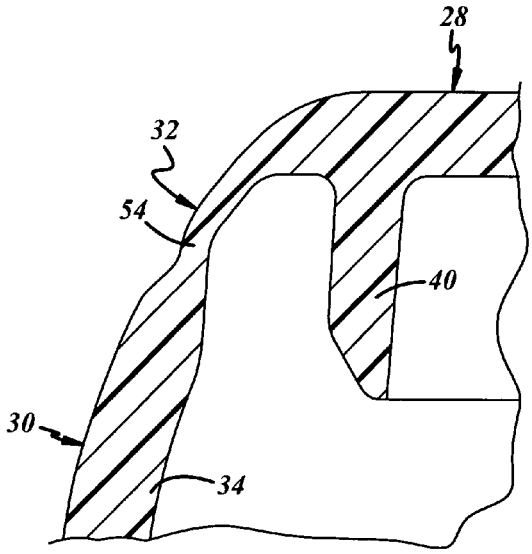
Figure 13:
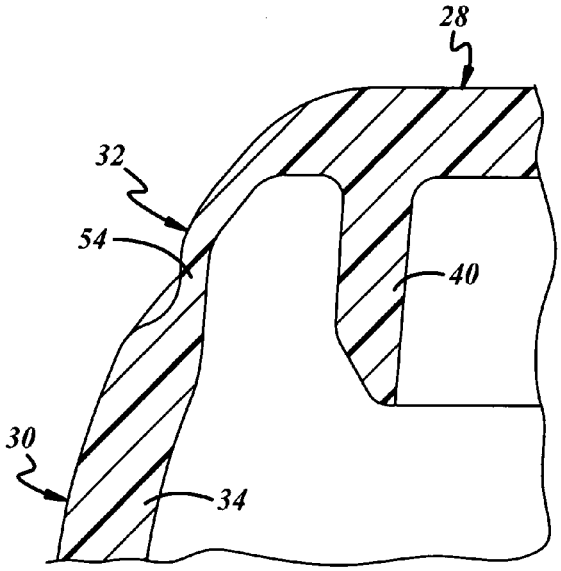
Figure 14:
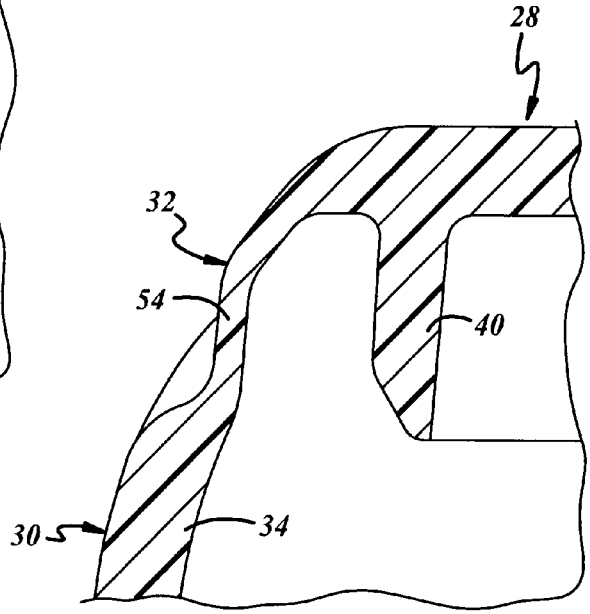
Figure 15:
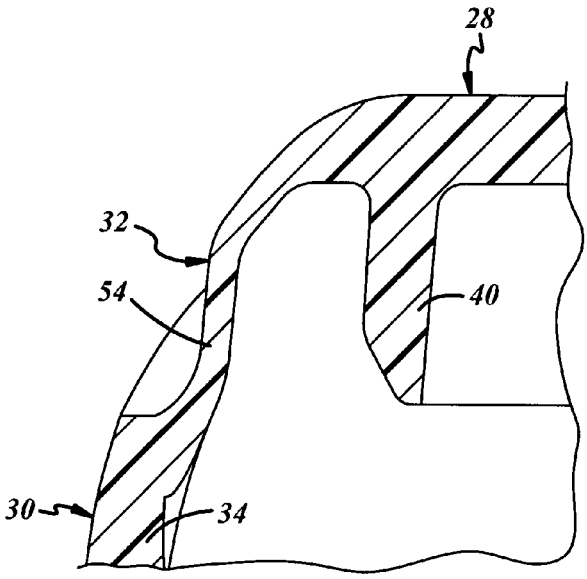

The upper edge of skirt 34 preferably curves inwardly and hinge 32 is displaced radially inwardly from the outer periphery of base 30, as best seen in FIGS. 6 and 8-15. The outer periphery of base 30 preferably is circular. Hinge 36 has a central portion 50 with a convex outer surface, with the lid closed and as viewed in side elevation (FIGS. 6 and 8), that blends with a smooth curvature into the outer surfaces of lid 28 and base 30. Hinge 32 also has angularly spaced end portions 52,54 on opposite sides of central portion 50. End portions 52,54 have concave outer surfaces with lid 28 closed (FIG. 15) forming pockets in the outer surface of the closure (FIG. 5). The hinge contour is illustrated in FIG. 6, which is a sectional view taken through the center of the hinge, and in FIGS. 8-15 that are sectional views taken at angles of 0°, 10°, 15°, 20°, 25°, 30°, 35° and 38° from the center of the hinge. The outer surface of hinge central portion 50 is convex with the lid closed, as illustrated in FIGS. 8-10. However, FIG. 11 shows the beginning of end portion 54, at an angle of 20° from the center of the hinge in this embodiment. In end portion 54, the outer surface of the hinge becomes concave, with the depth of this concavity increasing toward the outer edge of end portion 54, as progressively shown in FIGS. 12-15. In the same way, the inside surface of hinge 32 is concave in central portion 50 (FIGS. 6 and 8) and convex in end portion 54 (FIG. 15). Hinge end portion 52 is a mirror image of end portion 54. There are angular gaps 56, 58 (FIG. 7) between the ends of hinge end portions 52, 54 and the adjacent portions of skirt 34.

The hinge geometry so described and illustrated in the drawings has several advantages. The hinge geometry smoothly blends the exterior surface of closure base 30 with the exterior surface of closure lid 28 to provide an aesthetically pleasing appearance. Hinge 32 is positioned entirely within the outer periphery of closure base 36. The hinge provides an over-center snap-action that holds the lid in the open position (FIGS. 2 and 7). This snap-action can be manually overcome by moving the lid toward the closed position (FIGS. 1 and 3-5). The snap-action of the hinge tends to hold the lid in the closed position, as does the preferred press fit between wall 40 on lid 28 and the mouth of container neck finish 24. The hinge utilizes an outside-in single-element construction that reduces closure diameter, shut-offs and complexity, while improving functionality and appearance. External mold action is used to mold the hinge. This allows smaller closure diameters to be fabricated and increases the core-to-stripper clearance in the mold.

There thus have been disclosed a closure and a package that fully achieve all the objects and aims previously set forth. The closure and package have been disclosed in conjunction with an exemplary embodiment, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A plastic closure that includes a base molded as one piece with a lid and integrally connected to said lid by a hinge, said hinge being radially inwardly displaced from an outer periphery of said base, said hinge having a central portion with a convex outer surface with said lid closed and as viewed in side elevation, said convex outer surface blending with a smooth curvature into outer surfaces of said lid and said base, said hinge having laterally spaced end portions on opposite sides of said central portion, said end portions having concave outer surfaces with said lid closed, said lid being integrally connected to said base as molded by at least one frangible bridge spaced from said hinge, wherein said hinge is unitary and angularly extends from a center of said hinge to ends of said end portions of said hinge, and said hinge becomes concave at an angle from said center of said hinge, wherein a depth of the concavity progressively increases toward said ends of said end portions.

2. The closure set forth in claim 1 wherein said base has a circular periphery, and said end portions of said hinge are angularly spaced from each other.

3. The closure set forth in claim 2 wherein said outer surface of said lid is flat.

4. The closure set forth in claim 2 wherein said base has a skirt for securing said closure to a container neck finish.

5. The closure set forth in claim 4 wherein said lid has a thumb tab opposite said hinge and said base has a recessed edge underlying said thumb tab.

6. The closure set forth in claim 1 wherein said lid has an annular wall within said base for plug sealing engagement within a container neck finish.

7. A closure and container package that includes:

a container having a neck finish, and a plastic closure that includes a base molded as one piece with a lid and integrally connected to said lid by a hinge, said base having a skirt externally securing said closure to said container neck finish, said hinge having a central portion with a convex outer surface, with said lid closed and as viewed in side elevation, that blends with a smooth curvature into outer surfaces of said lid and said base, said hinge having laterally spaced end portions on opposite sides of said central portion, said end portions having concave outer surfaces with said lid closed, said lid being integrally connected to said base as molded by at least one frangible bridge spaced from said hinge, wherein said hinge is unitary and angularly extends from a center of said hinge to ends of said end portions of said hinge, and said hinge becomes concave at an angle from said center of said hinge, wherein a depth of the concavity progressively increases toward said ends of said end portions.

8. The package set forth in claim 7 wherein said container neck finish has an external bead and said skirt has an internal bead received by snap fit over said external bead.

9. The package set forth in claim 7 wherein said base of said closure has a circular periphery and said end portions of said hinge are angularly spaced from each other.

10. The package set forth in claim 9 wherein said outer surface of said lid is flat.

11. The package set forth in claim 9 wherein said lid has a thumb tab opposite said hinge and said base has a recessed edge underlying said thumb tab.

12. The package set forth in claim 11 wherein said lid has an annular wall in plug sealing engagement with said container neck finish.

13. The package set forth in claim 12 wherein said lid has a peripheral edge that overlies an end surface of said neck finish with said lid closed.

14. A plastic closure that includes a base molded as one piece with a lid and integrally connected to said lid by a single hinge, said hinge being radially inwardly displaced from an outer periphery of said base, said hinge having a central portion with a convex outer surface with said lid closed and as viewed in side elevation, said convex outer surface blending with a smooth curvature into outer surfaces of said lid and said base, said hinge having laterally spaced end portions on opposite sides of said central portion, said end portions having concave outer surfaces with said lid closed, wherein said hinge angularly extends from a center of said hinge to ends of said end portions of said hinge, and said hinge becomes concave at an angle from said center of said hinge, wherein a depth of the concavity progressively increases toward said ends of said end portions.

15. The closure set forth in claim 14 wherein said lid is integrally connected to said base as molded by at least one frangible bridge spaced from said hinge.

* * * * *